US007252574B2

(12) United States Patent
Chen

(10) Patent No.: US 7,252,574 B2
(45) Date of Patent: Aug. 7, 2007

(54) INTEGRAL THERMO-PRESS MOLDING COMPLEX BRASSIERE CUP STRUCTURE

(76) Inventor: Chin Tang Chen, 5F, No. 26. Jin Hua St., Taipei (TW)

( * ) Notice: Subject to any disclaimer, the term of this patent is extended or adjusted under 35 U.S.C. 154(b) by 107 days.

(21) Appl. No.: 11/034,881

(22) Filed: Jan. 14, 2005

(65) Prior Publication Data

US 2006/0160468 A1 Jul. 20, 2006

(51) Int. Cl.
*A41C 3/14* (2006.01)
*A41C 3/12* (2006.01)

(52) U.S. Cl. ..... 450/38; 450/54; 450/57

(58) Field of Classification Search ..... 450/38, 450/39, 54–57; 2/267, 268; 156/61, 66, 156/232, 245, 321; 264/241, 259, 260, 222, 264/264, 261, 266, 267; 623/7, 8
See application file for complete search history.

(56) References Cited

U.S. PATENT DOCUMENTS 3,845,507 A * 11/1974 Kirby et al. ..... 623/7
5,352,307 A * 10/1994 Wild ..... 156/66
5,792,292 A * 8/1998 Wild ..... 156/66
5,922,023 A * 7/1999 Mulligan et al. ..... 623/7
6,101,630 A * 8/2000 Lee ..... 2/57
6,283,820 B1 * 9/2001 Huang ..... 450/57
6,679,912 B2 * 1/2004 Stelter ..... 623/7
6,758,720 B2 * 7/2004 Chen ..... 450/57
6,857,932 B2 * 2/2005 Chen ..... 450/38
7,052,359 B2 * 5/2006 Chen et al. ..... 450/54

* cited by examiner

*Primary Examiner*—Gloria M. Hale
(74) *Attorney, Agent, or Firm*—Birch, Stewart, Kolasch & Birch LLP

(57) ABSTRACT

An integral thermo-press complex brassiere cup structure. The structure includes an external lining body, an internal lining body, a bag, a bag covering layer coupled on the surface of the bag made of a soft poor thermal conductor, and a material adhering layer disposed at the attaching surface of the internal and external lining bodies. The material adhering layer adheres the surface of the bag covering layer at an appropriate position between the internal and external lining bodies, and places both internal and external lining bodies into a high-temperature thermo-press mold for an integral molding process. The heat produced by the high-temperature mold is conducted through the internal and external lining bodies and delayed or blocked by the bag covering layer as to weaken the heat conducted to the bag.

8 Claims, 4 Drawing Sheets

INTEGRAL THERMO-PRESS MOLDING COMPLEX BRASSIERE CUP STRUCTURE

BACKGROUND OF THE INVENTION

1. Field of the Invention

The present invention relates to a brassiere cup, more particularly a complex brassiere cup structure worn by a female to beautify her figure.

2. Description of the Related Art

As social concepts become more liberal, women are getting more independent and have a more aggressive attitude to show off their figure with most of them being fastidious about their choice of underwear. To provide a variety of underwear products for female users, manufacturers are enthusiastic to pursue improvements and variations for the functions and artistic look of the underwear.

In recent years, brassiere designs tend to have centralized and lift-up support effects. Therefore, it is necessary to add padding bags to the structure of a brasserie and to use the padding bags to adjust the shape of female breasts to visually enhance the artistic look. to FIGS. 1 and 2 show the prior-art brassieres that comprise a fabric 11, 12 at the front and the back of a brassiere cup, foam layers 14, 14' respectively disposed inside, a padding bag 13 disposed at an appropriate position between the front and back fabrics 11, 12, with the padding bag 13 being made of two pieces of tough plastic films 131 (where a PU material is commonly used for this purpose) and which is filled with a liquid 132 or air. An upper mold 3' and a lower mold 3 are used for the high-temperature thermo-press molding process to produce a brassiere cup with a predetermined curvature.

Although a perfect centralized and lift-up support effect is accomplished after a woman wears this type of brassiere, there are still many technical problems of the manufacturing process that remain for manufacturers to overcome. Particularly, this type of brassiere cup makes use of a high temperature up to 200° C. for its press molding. Even with a padding bag 13 enclosed by two foam layers 14, 14', the upper mold 3' and the lower mold 3' will not be in direct contact during the thermo-press manufacturing, since the plastic film 131 can stand only a temperature of about 150° C., and will be melted or cracked easily when the manufacturing temperature gets too high. In serious cases, the defective products are eliminated directly after the inspection during the manufacturing process; but for a slightly melted case, particularly the one filled with a liquid 132, the defect cannot be found immediately during the inspection. As a result, the liquid 132 will leak and taint other underwear during the transportation, or will make other clothes dirty during the laundry process. This definitely constitutes quite a negative impact on the quality control of a brassiere cup production. Therefore, a manufacturer's objective is to include finding a way to reduce the possibility of having the padding bag 13 deformed or melted in order to maintain the product quality, to maximize the manufacturing yield rate, and minimize the defective rate for the manufacturing process.

SUMMARY OF THE INVENTION

Therefore, it is a primary objective of the present invention to provide an integral thermo-press molded complex brassiere cup structure that can reduce the possibility of a melted padding bag after it is heated and expanded during the production operation in order to assure the product quality, in addition to the function of beautifying the shape of female breasts.

The thermo-press molded complex brassiere cup structure in accordance with the present invention comprises an external lining body, an internal lining body, a bag filled with a filler, a bag covering layer and a material adhering layer. The bag and the bag covering layer are disposed at appropriate positions between the internal and external lining bodies. The bag is made by fusing its periphery with a tough thin film. A bag covering layer is disposed on the surface of the thin film and is made of a soft, poor thermal conductive material. The material adhering layer is disposed at the coupling surface between the internal and external lining bodies and the bag covering layer to adhere the surface of the bag covering layer at an appropriate position inside the internal and external lining bodies. Since the bag covering layer is a poor thermal conductor, the thermal press heat of the mold passing through the internal and external lining bodies and which is conducted to the poor thermal conductive bag covering layer is blocked or delayed so as to limit the expansion of the bag after being heated and therefore prevents melting the padding bag due to an excessive expansion. This assures the integrity of the bag. The defective rate of the brassiere cup produced by the thermo press molding process can be lowered greatly.

DETAILED DESCRIPTION OF THE PREFERRED EMBODIMENTS

Figure 3:
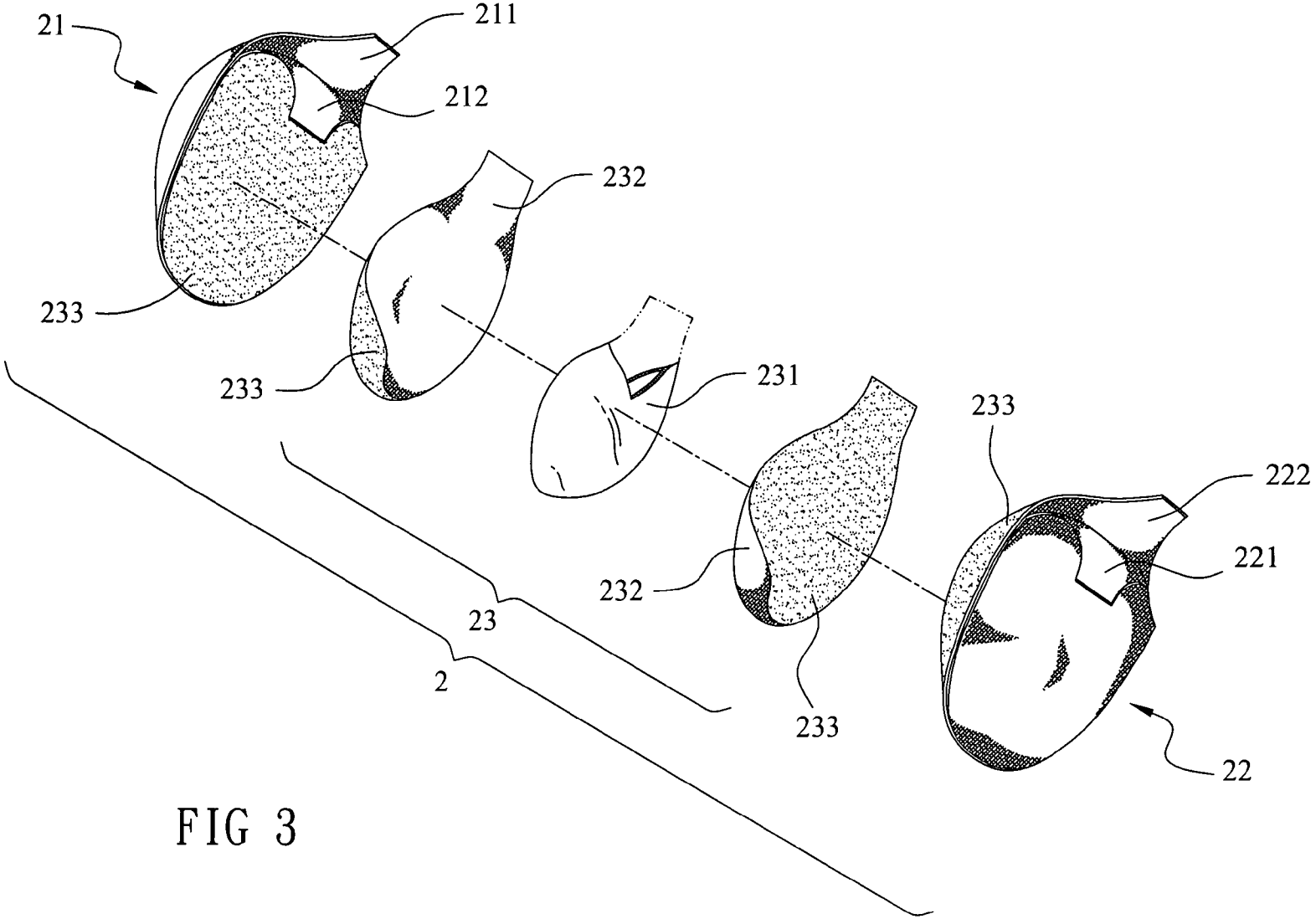
FIG. 3 is an exploded view of the brassiere cup structure according to a preferred embodiment of the present invention.
Figure 4:
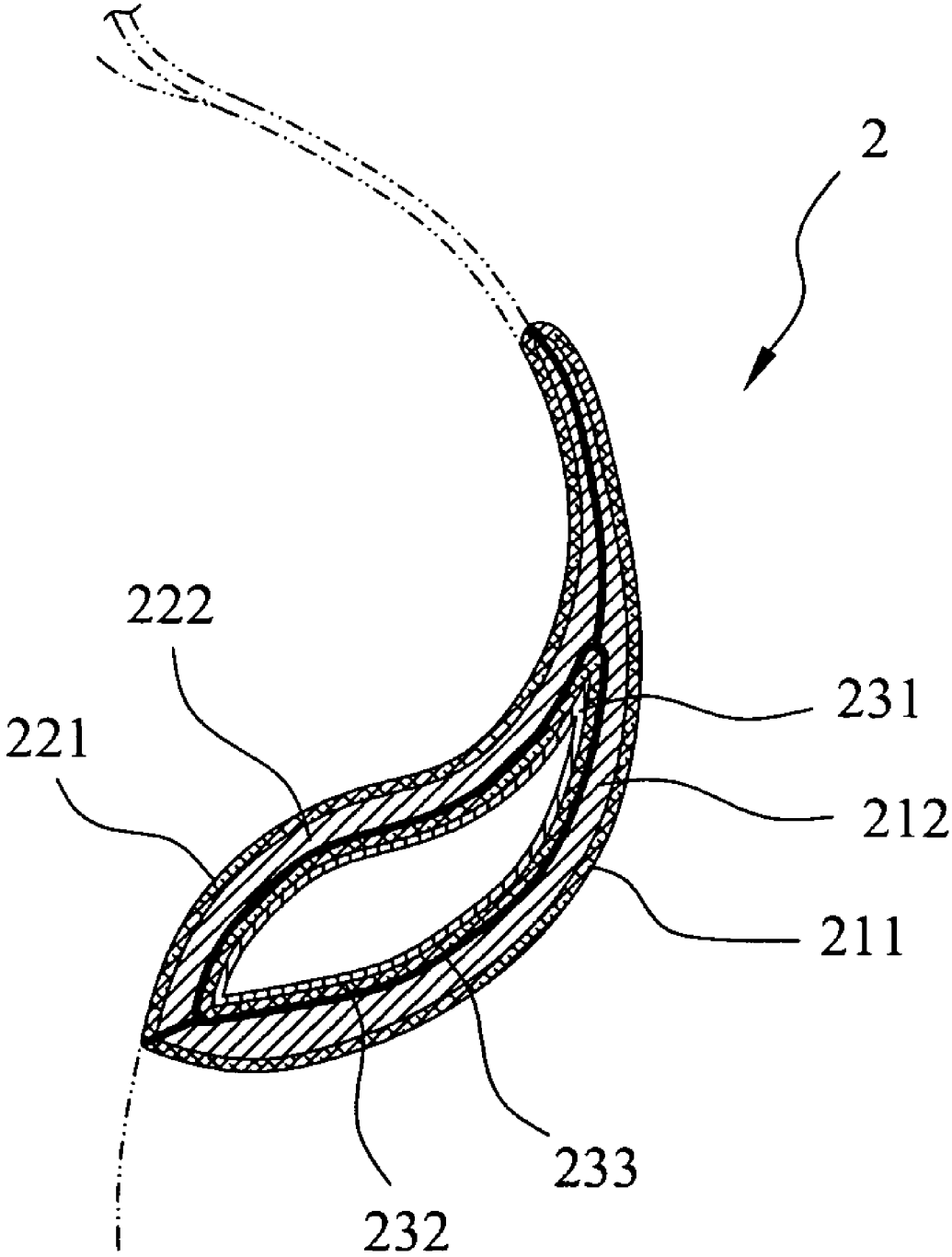
FIG. 4 is a sectional view of the brassiere cup structure being in its use according to a preferred embodiment of the present invention.

Please refer to FIGS. 3 and 4 for an integral thermo-press molded complex brassiere structure 2 according to a preferred embodiment of the present invention, which comprises an external lining body 21, an internal lining body 22 and a padding bag 23. The improved brassiere cups 2 are aligned symmetrically and sewed to a shoulder strap to be worn by female users.

The external lining body 21 has an external fabric layer 211 and an external foam layer 212. The external fabric layer 211 adopted in this embodiment is made of a cotton cloth and is adhered on the outer surface of the external foam layer 212. The internal lining body 22 has an internal fabric layer 221 and an internal foam layer 222. Similar to the external fabric layer 211, the internal fabric layer 221 is made of a cotton cloth and is adhered on the outer surface of the internal foam layer 222.

The internal foam layer 222 of the internal lining body 22 faces the external foam layer 212 of the external lining body 21, when the internal lining body 22 and the external lining body layers 222, 212 can be substituted by a non-woven fabric, since both non-woven fabric and foam have the same properties for the press-heat molding.

The padding bag 23 includes a bag 231, a bag covering layer 232, and a material adhering layer 233, wherein the bag 231 is made by sealing two pieces of plastic films (a PU plastic film is used in this embodiment) or any material selected from a resin and a silicon gel around the periphery by a high-frequency thermo-press process. The bag 231 can be filled with an oil fluid, a gas, an emulsified paste material (not shown in the figure) or a mixture of any two of the aforementioned materials, such that the appearance of the entire padding bag 23 is slightly protruded in a natural manner. This embodiment adopts an oil liquid to be filled inside the bag 231.

The bag covering layer 232 is made of a soft, poor thermal conductor, which completely covers the external circumferential surface of the bag 231. This embodiment adopts a cotton cloth for making the bag covering layer 232. However, the material is not limited to the cotton cloth, but any other cloth or poor thermal conductive material can be used as a substitute. The adhering material layer 233 can be divided into two sections sections. The two sections are placed in the directions facing opposite to each other on the adhering surface of the internal and external foam layers 222, 212 and the bag covering layer 212. The material adhering layer 233 extends beyond the cup into the interconnecting area between a left and right cup. This embodiment adopts a thermosetting plastic for the material adhering layer 233.

Figure 1:
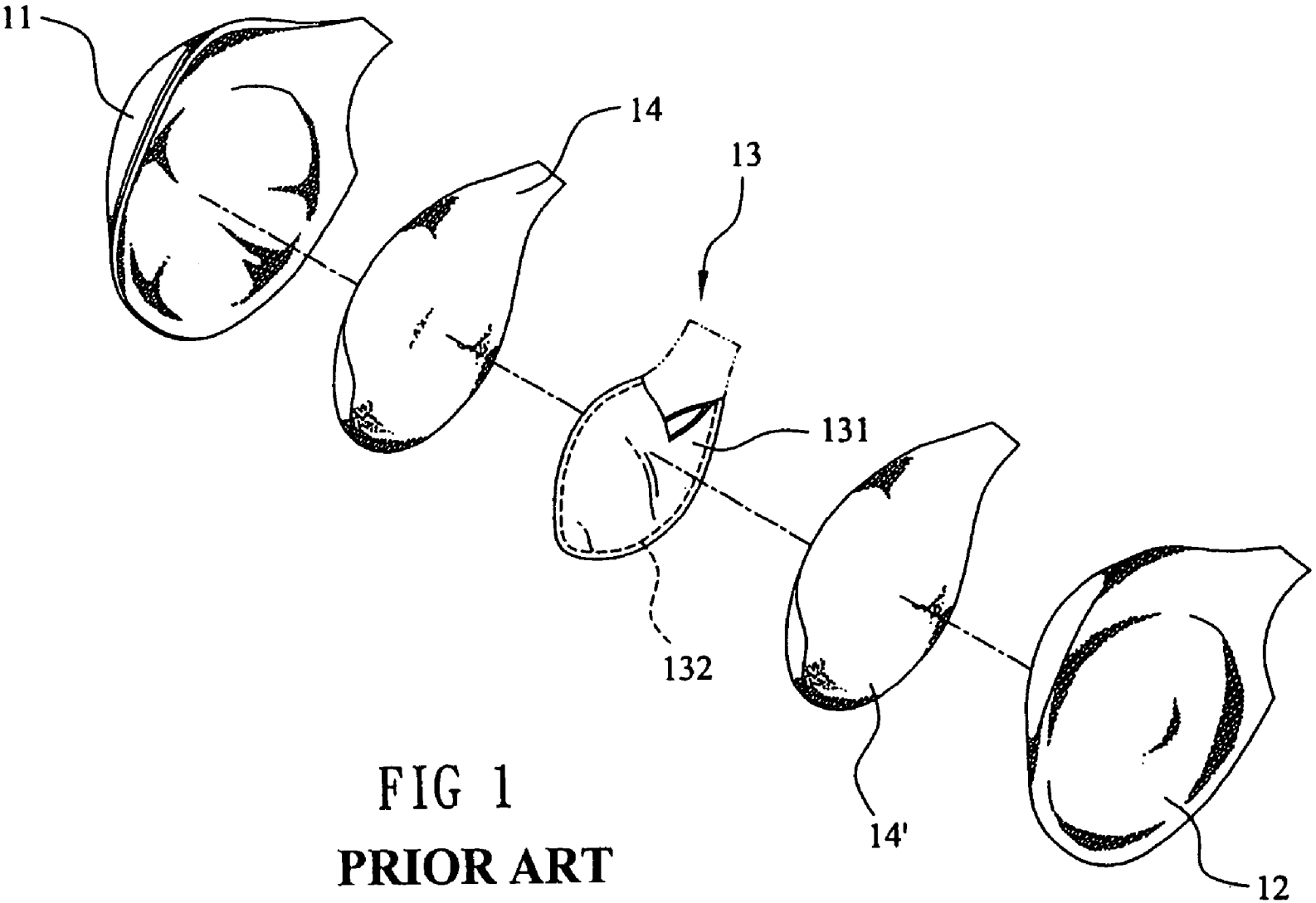
FIG 1 PRIOR ART
FIG. 1 is an exploded view of a prior-art brassiere cup.
Figure 2:
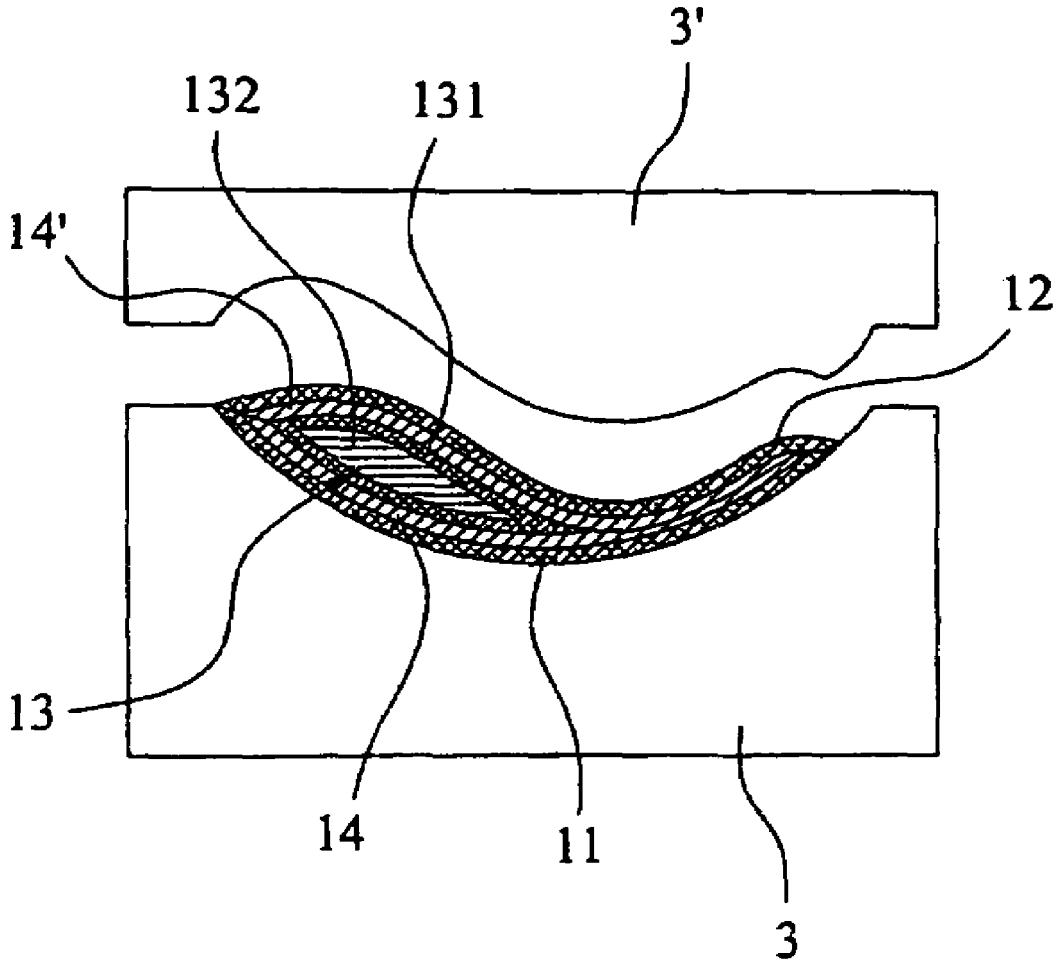
FIG 2 PRIOR ART
FIG. 2 is an illustrative view of a traditional prior art manufacturing process that adopts a lower mold and an upper mode for the brassiere cup molding.

Please refer to the upper mold 3' and the lower mold 3 as shown in FIG. 2 for the illustration of a molding process of the present invention. Firstly, the external lining body 21 is placed at the lower concave cambered surface of the lower mold 3 as to attach the curved surface of the external fabric layer 211 of the external lining body 21. Further, the external foam layer 212 faces upward, and the padding bag 23 is placed at an appropriate position on the external lining body 21.

Finally, the internal lining body 22 is placed on the padding bag 23, such that the external surface of the bag covering layer 232 of the padding bag 23 is covered by the internal and external lining bodies 22, 21. Then, the material adhering layer 233 is not completely adhered onto the external surface of the bag covering layer 232. As soon as all components are placed inside the lower mold 3, the upper mold 3' is moved downward.

Since both upper mold 3' and lower mold 3 are heated to a predetermined temperature, therefore an artistic look with a graceful curvature can be made by means of a high temperature press process after the upper mold 3' and the lower mold 3 are pressed. In the mean time, the material adhering layer 233 made of a thermosetting plastic has a strong adhesiveness after it is heated and covers the periphery of the bag covering layer 232 tightly, such that the internal and external foam layers 222, 212 can be attached closely onto the external surface of the bag covering layer 232.

In the high-temperature environment, the internal and external foam layers 222, 212 are attached by the adhesion of the material adhering layer 233, and finally the finished good is removed from the upper mold 3' and the lower mold 3 as shown in FIG. 4 to complete the thermo-press operation.

During the thermo-press molding process, it is necessary to adopt a high-temperature thermo-press measure to closely attach the internal and external foam layers 222, 212 while combining the whole internal lining body 22 and the external lining body 21 into a curvature to better fit the shape of female breasts.

Since the bag covering layer 232 covers the entire bag 231 from outside and the bag covering layer 232 is made of a poor thermal conductor material, the heat produced by the upper and lower molds 3', 3 is absorbed and conducted from the external lining body 21 and the internal lining body 22 and gradually to the bag covering layer 232 and the bag 231. In other words, the heat is conducted towards the central position of the brassiere cup 2). Before the heat reaches the bag 231, the poor thermal conductive bag covering layer 232 reduces the thermal conductive efficiency, and thus the heat cannot pass through the bag covering layer 232 quickly to the bag 231, and the bag covering layer 232 delays the thermal conduction and slows down the heat absorption of the bag 231 as to greatly reduce the extent of deformation of the bag 231.

Under a high-temperature environment, the bag 231 according to this embodiment will not be deformed easily. If the bag 231 is expanded due to the heat, the bag covering layer 232 also can effectively restrict the deformation of the bag 23 to directly lower the possibility of cracking the bag 231. However, it is noteworthy that this embodiment adopts a filler including but not limited to an oil liquid for the bag 231. If air is filled, the bag covering layer 232 still can restrict the expansion of the bag 231 to limit the deformation of the bag 231, even if the related coefficient of thermal expansion is large.

On the other hand, if the material of the bag 231 is partially melted due to an overheat, and the slightly formed PU portion is flowed into the gaps between the fibers of the bag covering layer 232 to form a seal between the PU material, the adhering material and the fibers. As a result, the liquid or air filled inside the bag 231 can be prevented from overflowing fibers. As a result, the liquid or air filled inside the bag 231 can be prevented from overflowing or leaking; a continuous leak of the fluid can be prevented; and the padding bag 23 will keep its original natural protruded form to assure the function of the brassiere cup 2 and provide a graceful curvature for supporting female breasts.

In summation of the description above, the integral thermo-press molded complex brassiere cup structure in accordance with the present invention restricts the deformation and overheating by the bag covering layer 232 outside the bag 231 to prevent the padding bag 23 from being cracked or damaged easily. Therefore, the content filled inside the bag 231 will not leak easily. In other words, if the bag 231 is partially deformed or melted due to the overheat operating temperature, some part of the material of the bag 231 is melted and flows into the bag covering layer 232 to maintain the insulating effect of the bag covering layer 232 and prevent a continual leak of the contents filled in the bag 231. The present invention not only improves the yield rate of the brassiere cup 2 of the brassiere product, but also maintains the padding bag 23 constantly in a slightly protruded form so as to show the perfect shape of female breast and the natural appealing female figure.

While the invention has been described in terms of preferred embodiments, it is to be understood that the invention is not limited thereto. To the contrary, it is intended to cover various modifications and similar arrangements and procedures, and the scope of the appended claims should be accorded the broadest interpretation so as to encompass all such modifications and similar arrangements and procedures.

What is claimed is:

1. An integral thermo press molded complex brassiere cup structure, comprising:

an external lining body, an internal lining body, a padding bag filled with a content, and having a tough thin film fused about its periphery forming a surface of said bag about said filling, a bag covering layer, said padding bag and said bag covering layer being located at a position between said internal and external lining bodies said bag covering layer, being coupled to said thin film surface of said bag and is made of a soft, poor thermally conductive material; a material adhering layer being disposed on a surface of said bag covering layer and coupled to said internal and external lining bodies, thereby the surface of said bag covering layer being adhered at an appropriate position inside said internal and external lining bodies when thermo press molded.

2. The integral thermo press molded complex brassiere cup structure of claim 1, wherein said internal and external lining bodies preferably include a material selected from the collection of a foam sponge and a non-woven fabric for thermo-press molding.

3. The integral thermo press molded complex brassiere cup structure of claim 1, wherein said internal and external lining bodies have outer surfaces formed by an internal fabric layer and an external fabric layer respectively.

4. The integral thermo press molded complex brassiere cup structure of claim 1, wherein said bag covering layer is made of a poor thermal conductive fabric material.

5. The integral thermo press molded complex brassiere cup structure of claim 1, wherein said content of said bag is a material selected from the collection of a gas, an oil liquid, and an emulsified paste.

6. The integral thermo press molded complex brassiere cup structure of claim 1, wherein said content of said bag is made of a mixture of at least two materials.

7. The integral thermo press molded complex brassiere cup structure of claim 1, wherein said material adhering layer is made of a thermosetting plastic material.

8. The integral thermo press molded complex brassiere cup structure of claim 1, wherein said material adhering layer extends beyond said cup into an interconnecting area between a brassiere left and right brassiere cup; and is located between the internal and external lining bodies.

* * * * *